US008776414B2

(12) United States Patent
Clark et al.

(10) Patent No.: US 8,776,414 B2
(45) Date of Patent: Jul. 15, 2014

(54) MEDIA DISPLAY ASSEMBLY AND MERCHANDISING SYSTEM ASSOCIATED THEREWITH

(75) Inventors: Jeremy A. Clark, Minneapolis, MN (US); Amy M. Bacskai, St. Paul, MN (US); Robert G. Logan, Blaine, MN (US); David Cheney, St. Paul, MN (US)

(73) Assignee: Target Brands, Inc., Minneapolis, MN (US)

( * ) Notice: Subject to any disclaimer, the term of this patent is extended or adjusted under 35 U.S.C. 154(b) by 243 days.

(21) Appl. No.: 13/364,914

(22) Filed: Feb. 2, 2012

(65) Prior Publication Data

US 2013/0199066 A1 Aug. 8, 2013

(51) Int. Cl.

| | |
|---|---|
| ***G09F 15/00*** | (2006.01) |
| ***G09F 15/02*** | (2006.01) |
| ***G09F 7/20*** | (2006.01) |

(52) U.S. Cl.

CPC .. *G09F 7/20* (2013.01); *G09F 15/02* (2013.01)
USPC ..... 40/607.01; 40/515; 40/605; 40/607.1; 40/607.12; 40/658; 40/660; 40/657; 40/611.1; 40/607.09; 40/607.02; 40/790; 211/187; 211/87.01; 108/107; 108/109; 108/110; 248/220.41; 248/220.42

(58) Field of Classification Search

CPC ..... G09F 7/18; G09F 7/20
USPC ..... 40/515, 607.01, 605, 607.1, 607.12, 40/658, 660, 657, 611.1, 607.09, 607.02, 40/790; 211/187, 87.01; 108/107, 109, 108/110; 248/220.41, 220.42
See application file for complete search history.

(56) References Cited

U.S. PATENT DOCUMENTS

| | | | | |
|---|---|---|---|---|
| 1,824,578 | A | | 9/1931 | Thake |
| 2,915,196 | A | * | 12/1959 | Pira ..... 108/109 |
| D194,019 | S | | 11/1962 | Smith |
| 4,742,633 | A | | 5/1988 | Snediker |
| 4,790,091 | A | | 12/1988 | Hull |
| 4,827,648 | A | * | 5/1989 | Danin ..... 40/783 |
| 4,854,533 | A | | 8/1989 | Sainato |
| 4,887,783 | A | | 12/1989 | Franklin |
| 5,012,603 | A | | 5/1991 | Elcock |

(Continued)

OTHER PUBLICATIONS

Office Action from Canadian Patent Application No. 2,766,463, mailed May 14, 2012 (2 pages).

(Continued)

*Primary Examiner* — Syed A Islam
(74) *Attorney, Agent, or Firm* — Griffiths & Seaton PLLC; JoAnn M. Seaton

(57) ABSTRACT

A media display assembly comprises a support and a sign holder. The support defines a substantially vertical section, a substantially horizontal section, and a bent transition section extending between the substantially vertical section and the substantially horizontal section. The support is formed in a substantially L-shape. The sign holder includes a first panel and a second panel sized substantially identically to the first panel. The first panel and the second panel are coupled to one another along a closed edge of the sign holder and define a slot therebetween them for receiving a sign. The second panel of the sign holder is coupled to the substantially vertical section of the support on a side of the substantially vertical section opposite the substantially horizontal section. The second panel of the sign holder extends in a plane substantially perpendicular to the substantially horizontal section of the support.

21 Claims, 11 Drawing Sheets

(56) References Cited

U.S. PATENT DOCUMENTS

| | | | | |
|---|---|---|---|---|
| 5,236,095 | A | 8/1993 | Krizka | |
| 5,443,167 | A | 8/1995 | Menaged et al. | |
| 5,462,178 | A * | 10/1995 | Wallach et al. | 211/95 |
| 5,660,286 | A * | 8/1997 | Shea | 211/87.01 |
| 5,722,623 | A | 3/1998 | Gibson | |
| 5,933,992 | A | 8/1999 | Padiak et al. | |
| RE36,669 | E | 4/2000 | Zilincar, III | |
| D434,082 | S | 11/2000 | Tsiogas | |
| 6,186,454 | B1 * | 2/2001 | Olsen | 248/218.4 |
| D454,373 | S | 3/2002 | Kosir | |
| 6,523,291 | B2 | 2/2003 | Nagel | |
| 6,533,134 | B1 * | 3/2003 | Menaged et al. | 211/87.01 |
| 6,601,328 | B1 | 8/2003 | Benaquista et al. | |
| 6,698,124 | B2 | 3/2004 | Kump et al. | |
| 6,932,226 | B2 | 8/2005 | Hardy | |
| 7,600,895 | B2 | 10/2009 | Hawkins et al. | |
| D647,978 | S | 11/2011 | Bacskai et al. | |
| 2006/0081276 | A1 * | 4/2006 | Tung | 135/16 |
| 2008/0149576 | A1 | 6/2008 | Onachilla et al. | |

OTHER PUBLICATIONS

U.S. Appl. No. 29/412,399, filed Feb. 2, 2012 (9 pages).

* cited by examiner

MEDIA DISPLAY ASSEMBLY AND MERCHANDISING SYSTEM ASSOCIATED THEREWITH

CROSS-REFERENCE TO RELATED APPLICATION

This application is related to U.S. application Ser. No. 29/412,399 filed on an even date herewith, and entitled "SIGN HOLDER."

BACKGROUND OF THE INVENTION

Typically, space in a retail store is at a premium as it is inherently limited by the square footage of the particular store. Many different merchandising display structures have been developed to display as much product to consumers as possible in a given amount of space. Despite a desire to present a high volume of product to consumers, many retailers still strive to present the product in a manner that is visually appealing to consumers. In one example, such displays benefit from dividing structures to visually break up a long aisle of product and/or signs to provide the consumer with additional information about or otherwise market nearby products being offered for sale. To attract consumer attention and/or inform consumers about particular nearby products or other store related items, in some cases, the display structures include signs or other conspicuous indicia. While such signs need to be at least somewhat conspicuous, the space constraints for the entire merchandising system typically limit placement and size options for the signs.

SUMMARY OF THE INVENTION

One aspect of the present invention relates to a media display assembly. The media display assembly comprises a support and a sign holder. The support defines a substantially vertical section, a substantially horizontal section, and a bent transition section extending between the substantially vertical section and the substantially horizontal section. The support is formed in an inverted substantially L-shape. The sign holder includes a first panel and a second panel sized substantially identically to the first panel. The first panel and the second panel are coupled to one another along a closed edge of the sign holder and define a slot between the first panel and the second panel for receiving a sign. The second panel of the sign holder is coupled to the substantially vertical section of the support on a side of the substantially vertical section opposite the substantially horizontal section. The second panel of the sign holder extends in a plane substantially perpendicular to the substantially horizontal section of the support. Other embodiments, related systems, methods, and associated combinations are also disclosed.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides examples and is not intended to limit the invention or the application and uses of the invention. Furthermore, there is no intention to be bound by any theory presented in the preceding background of the invention or the following detailed description of the invention.

Embodiments of the present invention depict a media display assembly configured to be selectively secured to a merchandise display unit and to provide support for signs or other media related to merchandise displayed near the media display assembly. In one example, the media display assembly has a small footprint relative to a merchandise display unit while still providing relatively large amount of space for receiving one or more signs or other media members. In one instance, the media display assembly further provides a visual divider to a merchandise display unit providing a visual break in merchandise presentation and contributing to the overall pleasing aesthetic of the merchandising system.

Figure 1:
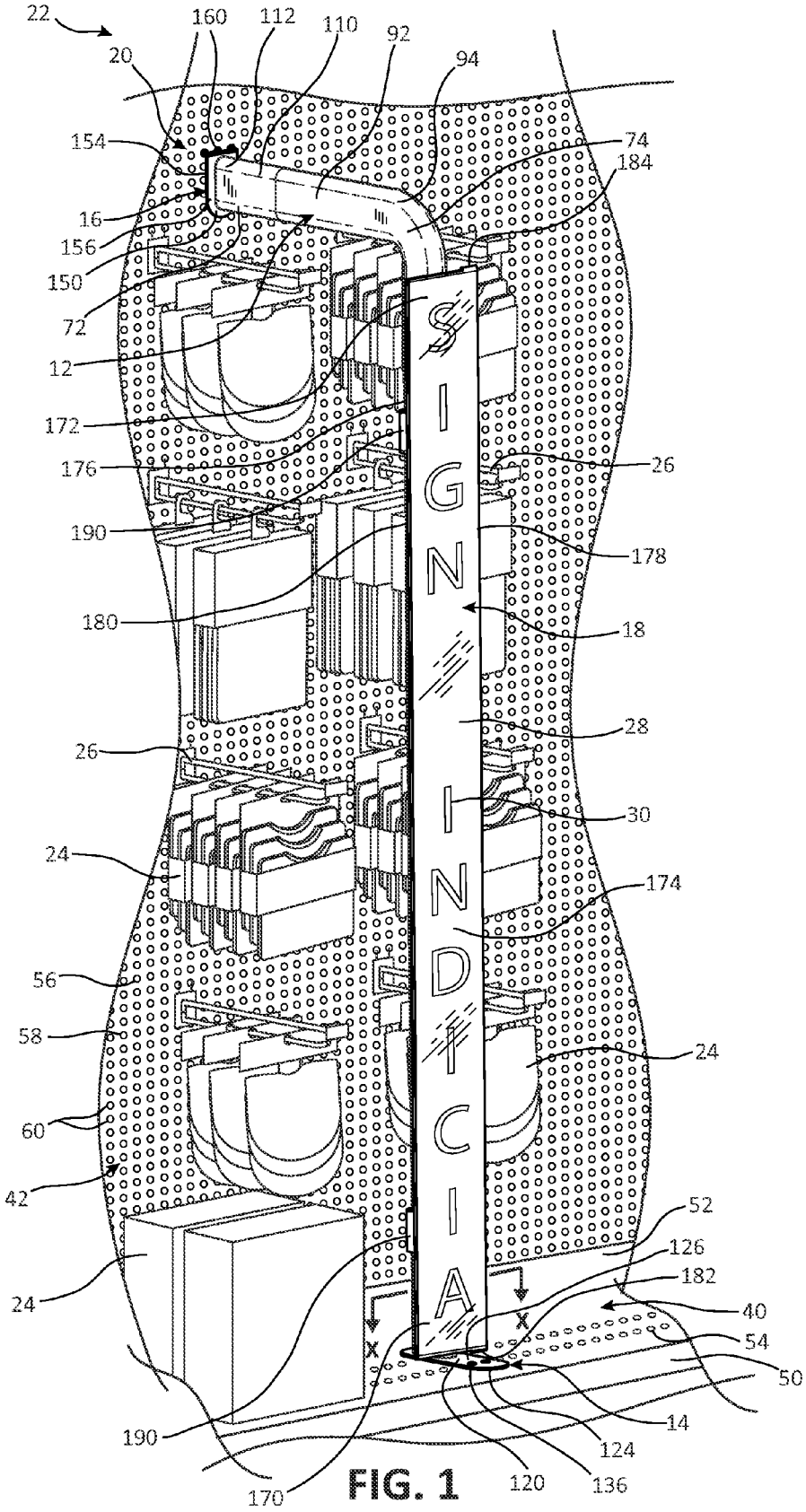
FIG. 1 is a front, perspective view illustration of a merchandising system including a media display assembly and a merchandise display unit, according to one embodiment of the present invention.
Figure 2:
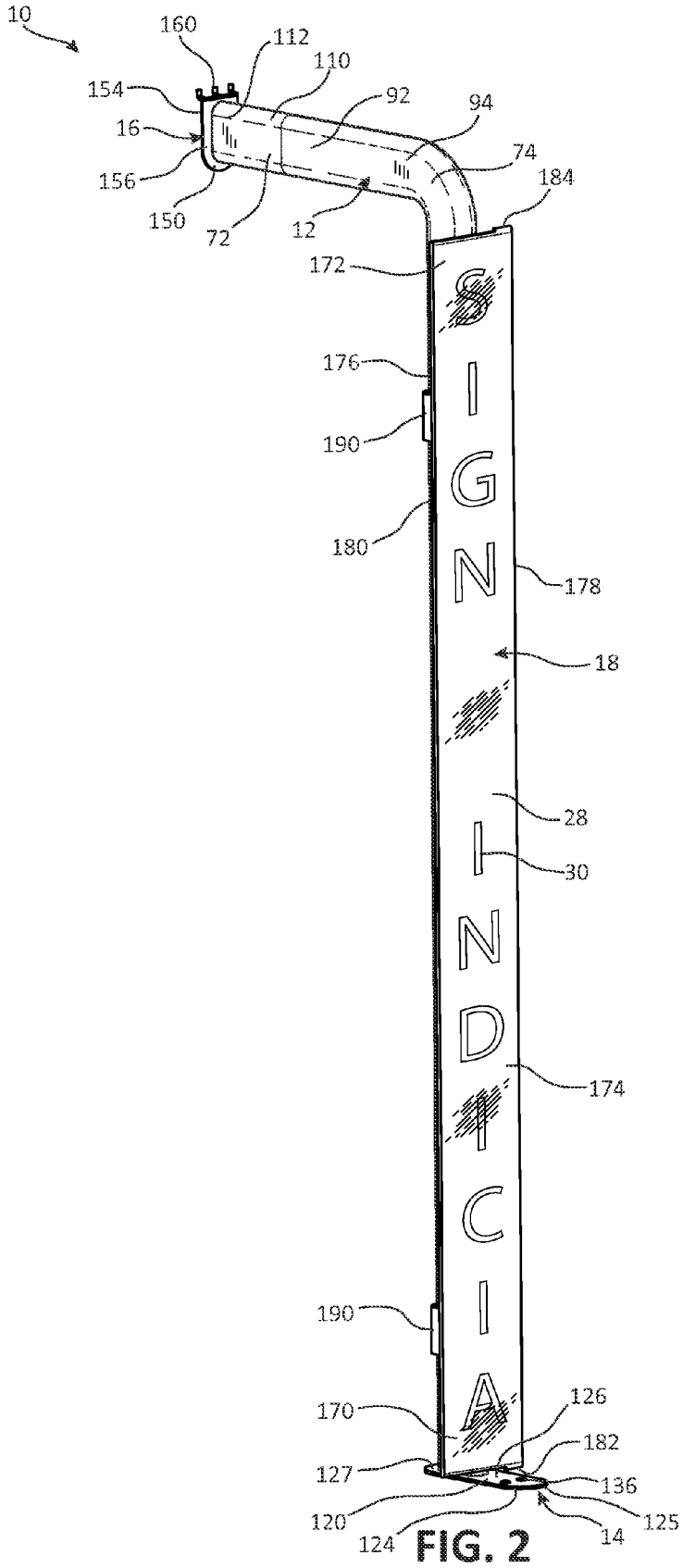
FIG. 2 is a front, perspective view illustration of a media display assembly, according to one embodiment of the present invention.
Figure 3:
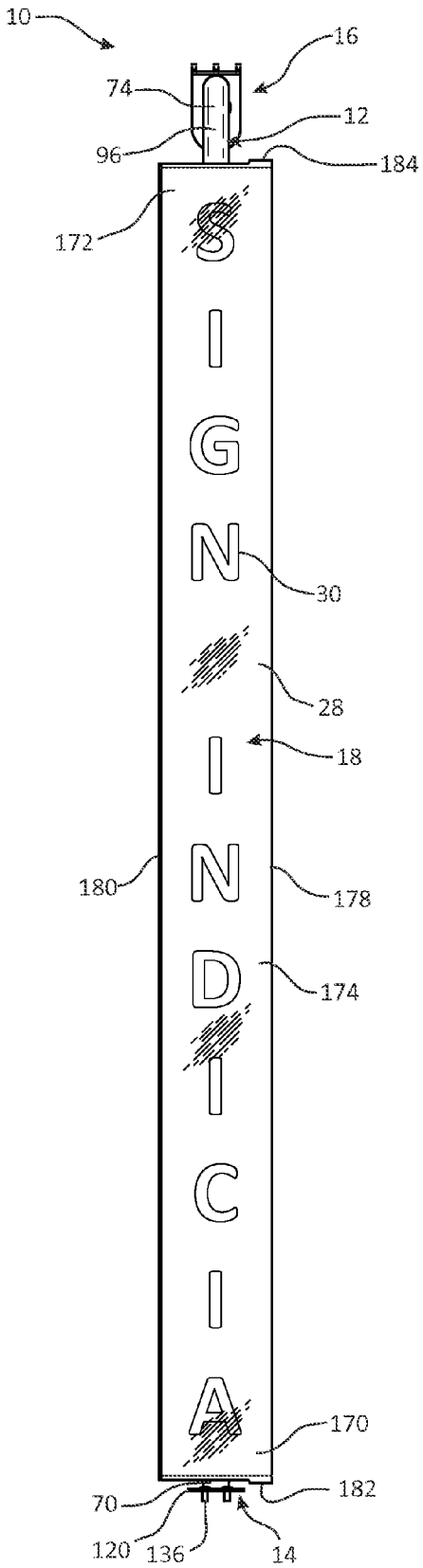
FIG. 3 is a front view illustration of the media display assembly of FIG. 2, according to one embodiment of the present invention.
Figure 4:
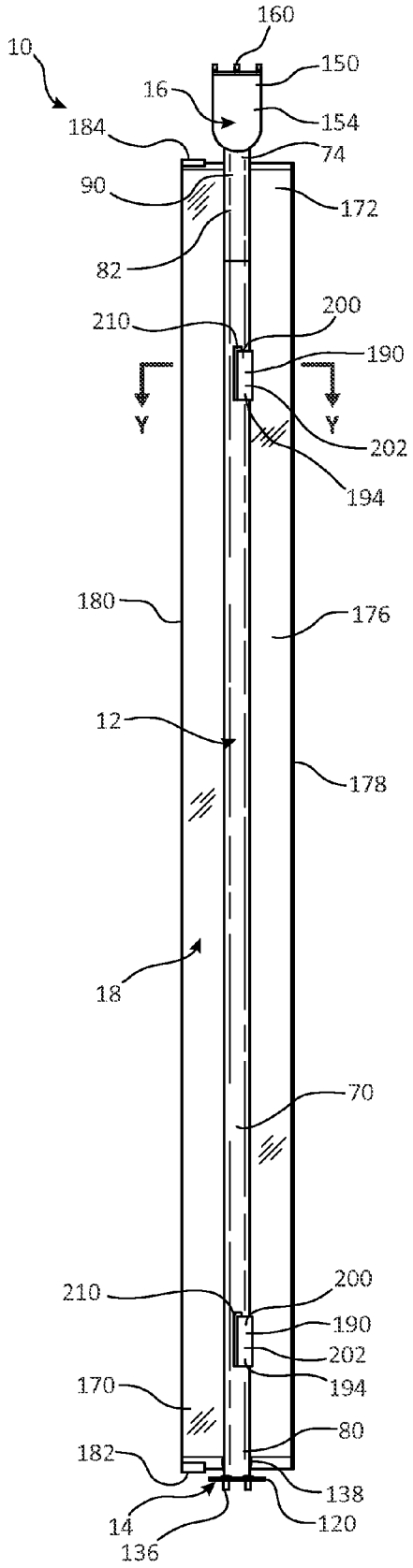
FIG. 4 is a rear view illustration of the media display assembly of FIG. 2, according to one embodiment of the present invention.
Figure 5:
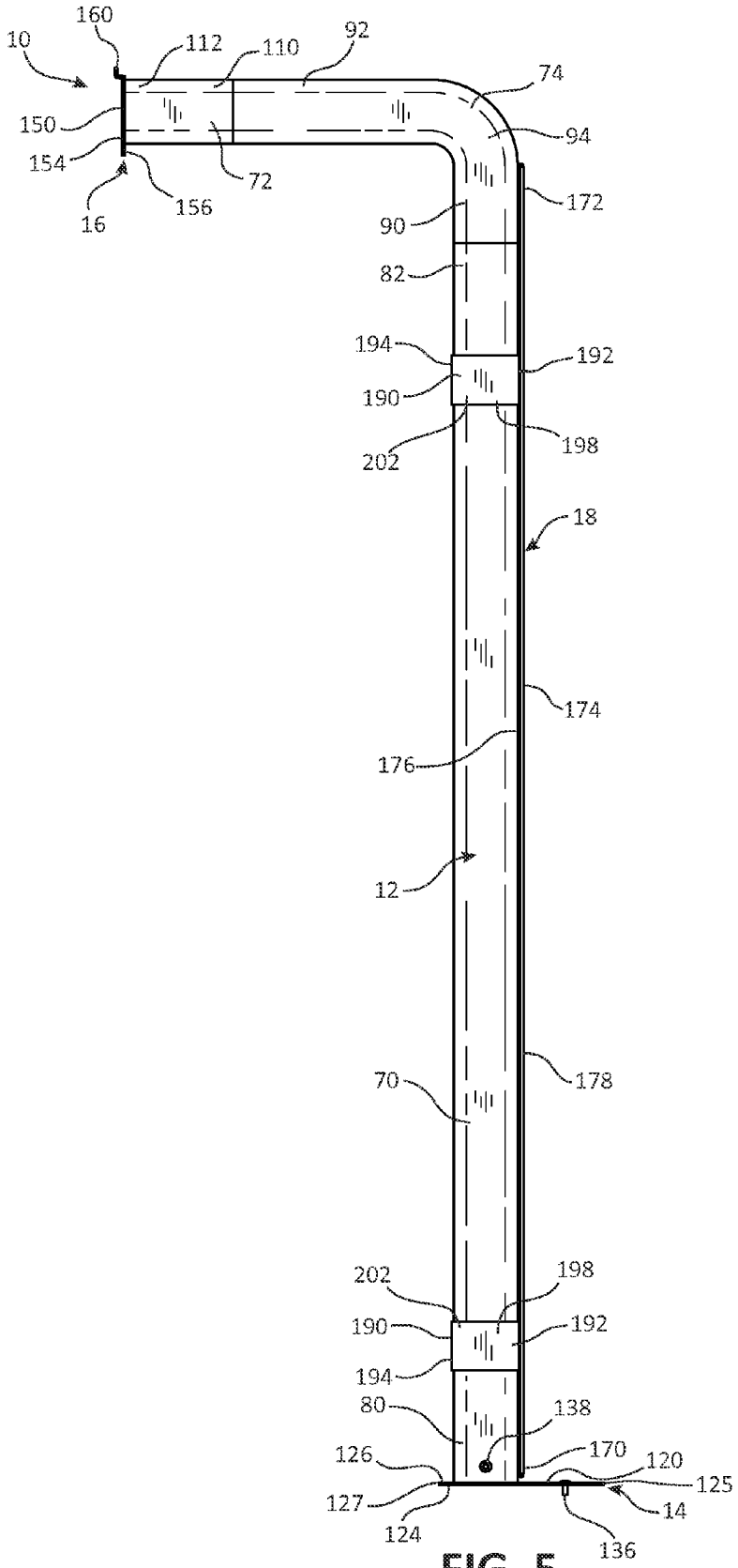
FIG. 5 is a left side view illustration of the media display assembly of FIG. 2, according to one embodiment of the present invention.
Figures 6, 7, 8:
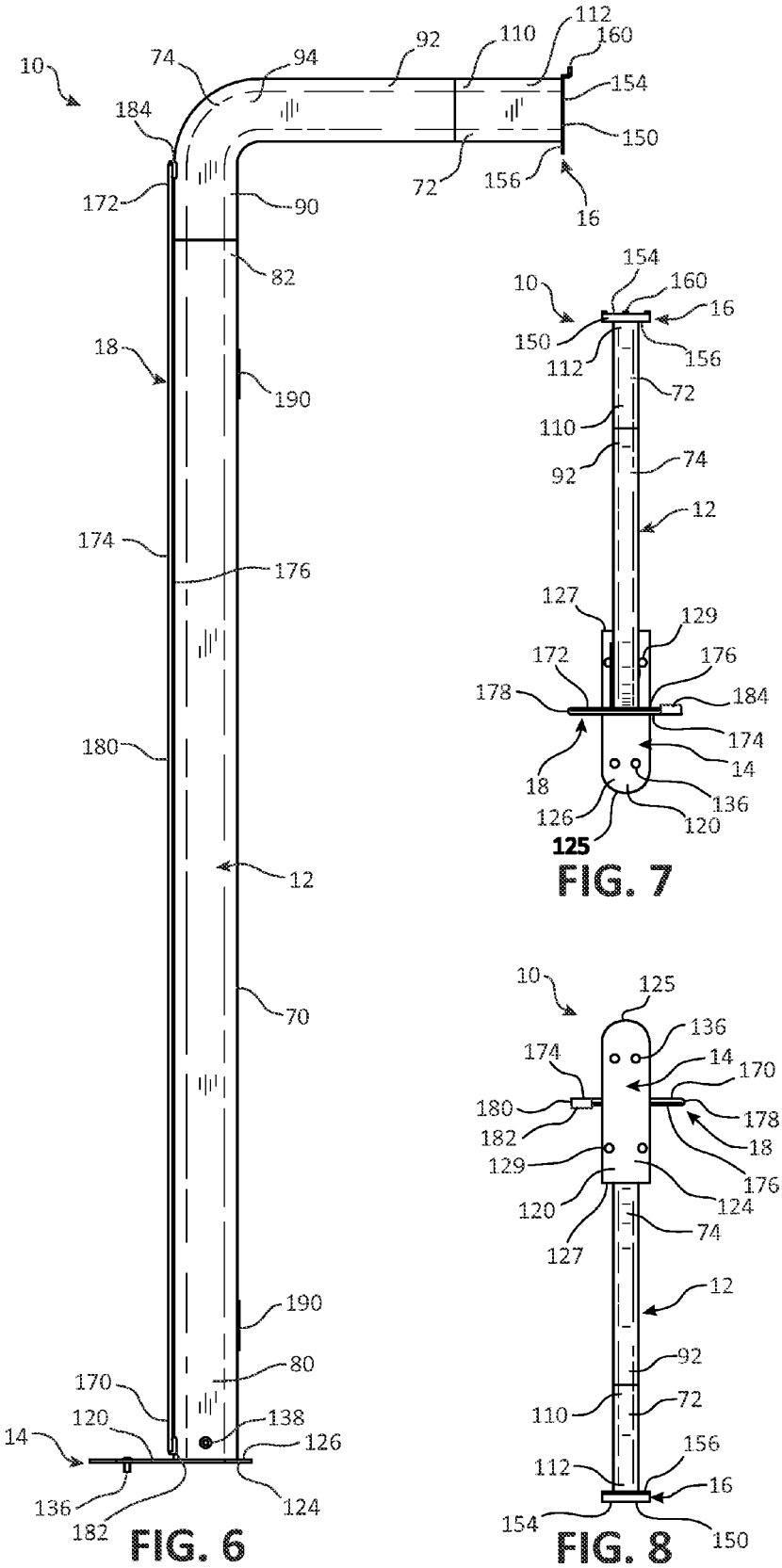
FIG. 6 is a right side view illustration of the media display assembly of FIG. 2, according to one embodiment of the present invention.
FIG. 7 is a top view illustration of the media display assembly of FIG. 2, according to one embodiment of the present invention.
FIG. 8 is a bottom view illustration of the media display assembly of FIG. 2, according to one embodiment of the present invention.

Turning to FIG. 1, in one embodiment, a media display assembly 10 is provided including a support or divider structure 12, mounting components 14 and 16, and sign holder 18. Divider structure 12 supports sign holder 18 and is coupled to a merchandise display until 20 via mounting components 14 and 16 such that the media display assembly 10 and the merchandise display unit 20 collectively define a merchandising system 22. Merchandise display unit 20 is configured to support merchandise or products 24 being offered for sale, e.g., via hanging or support rods 26 and/or via substantially horizontal shelving (not shown). Media display assembly 10 provides a visual break to displayed products 24 and is configured to selectively support media, such as a sign 28 including indicia 30 related to, e.g., products 24 displayed on merchandise display unit 20 near media display assembly 10.

In one example, merchandise display unit 20 is a gondola type unit including a base deck 40 and a vertical wall 42 extending upwardly therefrom. Base deck 40 defines a front edge 50 facing toward a retail store aisle (not shown) and a top surface 52. Vertical wall 42 extends upwardly from top surface 52 and is spaced rearwardly from front edge 50 of base deck 40. In one example, base deck 40 defines two or more substantially linear rows of apertures 54 extending along and through top surface 52, more particularly extending adjacent and substantially parallel to front edge 50 of base deck 40. In one embodiment, vertical wall 42 provides a pegboard panel 56 extending substantially parallel to front edge 40 of base deck 30. Pegboard panel 56 defines a front, substantially planar surface 58 having an array of apertures 60 arranged thereon and extending therethrough. Products 24 are displayed on support rods 26 or similar supporting structure extending outwardly from front, substantially planar surface 56 of pegboard panel 44, and therefore, of vertical wall 42, as will be apparent to those of skill in the art upon reading this application.

Additionally referring to FIGS. 2-8, divider structure 12 of media display divider 10 is, in one example, configured to be separately coupled with both of base deck 20 and vertical wall 42. Accordingly, in one embodiment, divider structure 12 is an inverted, substantially "L" shaped including a first elongated or substantially vertical section 70 and a second elongated or substantially horizontal section 72 extending rearwardly therefrom with a transition section 74 extending therebetween and joining substantially vertical section 70 and substantially horizontal section 72 to one another. As illustrated, transition section 74 forms an intersection between substantially vertical section 70 and substantially horizontal section 74 and may be rounded while, in other embodiments, transition section 74 maybe be more sharply angled or bent to generally defines a ninety degree transition in orientation of divider support 12. While pictured and primarily described herein as each being separate members configured to be assembled together, in other examples, two or all of substantially vertical section 70, transition section 72, and substantially horizontal section 74 are formed as a single piece and the "section" description herein merely relates to a portion of that single piece. In view of the above, substantially horizontal section 72 is one example of means for extending from substantially vertical section 70 toward vertical wall 42.

In one embodiment, substantially vertical section 70 includes a first or bottom end 80 and a second or top end 82 and extends substantially linearly therebetween. In one example, substantially vertical section 70 is formed of a hollow tubular member, e.g., formed of molded plastic or other suitable material. As such, a cavity 84 is formed therein and extends from bottom end 80 to top end 82 as illustrated. In other examples, shorter cavities may be formed to each extend inwardly for a limited distance from each of bottom end 80 and top end 82 and/or cavity 84 may be eliminated altogether. Exposed end edges 81 and 83 are formed by substantially vertical section 70 by bottom end 80 and top end 82, respectively.

Transition section 74 defines and extends between first end 90 and second end 92, and, in one example, is defined by a tubular member, which may or may not be hollow. Transition section 74 defines a orientation turn or bend 94 between first end 90 and second end 92, for example, a bend of about ninety degrees, such that first end 90 and second end 92 extend in directions substantially perpendicularly to one another. In one embodiment, each of first end 90 and second end 92 defines a radially inset portion 96 centered relative to outermost cross-sectional perimeter of each first end and second end 92. A ledge 98 is formed extending radially inwardly from the outermost cross-section perimeter to the inset portion 96. Radially inset portion 96 extends outwardly from bend 94 farther than the remainder of transition section 74.

In one embodiment, substantially horizontal section 20 includes a first or front end 110 and a second or rear end 112 and extends substantially linearly therebetween. In one example, substantially horizontal section 72 is formed of a hollow tubular member, e.g., formed of molded plastic or other suitable material. As such, a cavity 114 is formed therein and extends from front end 110 to rear end 112 as illustrated. In other examples, shorter cavities may be formed to each extend inwardly for a limited distance from each of front end 110 and rear end 112 and/or cavity 114 may be eliminated altogether. Exposed end edges 111 and 113 are formed by substantially horizontal section 72 by front end 110 and rear end 111, respectively.

In the illustrated embodiment, where substantially vertical section 70, substantially horizontal section 72, and transition section 74 are formed as separate pieces, each of substantially vertical section 70 and substantially horizontal section 72 are coupled to opposing first end 90 and second end 92 of transition section 74, respectively. More specifically, in one example, radially inset portion 96, which protrudes outwardly from a remainder of transition section 74, formed by front end 90 of transition section 74 is placed into cavity 84 of substantially vertical section 70. Exposed end edge 83 of substantially vertical section 70 directly abuts face to face with ledge 98 formed around radially inset portion 96 formed by front end 90 of transition section 74. Similarly, radially inset portion 96, which protrudes outwardly from a remainder of transition section 74, formed by rear end 92 of transition section 74 is placed into cavity 114 of substantially horizontal section 72. Exposed end edge 111 of substantially horizontal section 72 directly abuts face to face with ledge 98 formed around radially inset portion 96 formed by rear end 90 of transition section 74.

The coupling of each of substantially vertical section 70 and substantially horizontal section 72 with transition section 74 may be solely via friction fit and/or may be effectuated by a combination of friction fit, adhesive, ultrasonic welding, and/or other fastener as will be apparent to those of skill in the art upon reading this application. In one embodiment, the resultant divider support 12 appears as a continuous tube or elongated member with a single bend 94 whether divider support 12 is formed as a single piece or as composite pieces. Although described as above and pictured as transition section 74 defining radially inset portions 96 and substantially vertical section 70 and substantially horizontal section 72 defining cavities 84 and 114, one of skill in the art will understand that those inclusions can be the opposite as described with substantially vertical section 70 and substantially horizontal section 72 including radially inset portions, etc.

Figure 10:
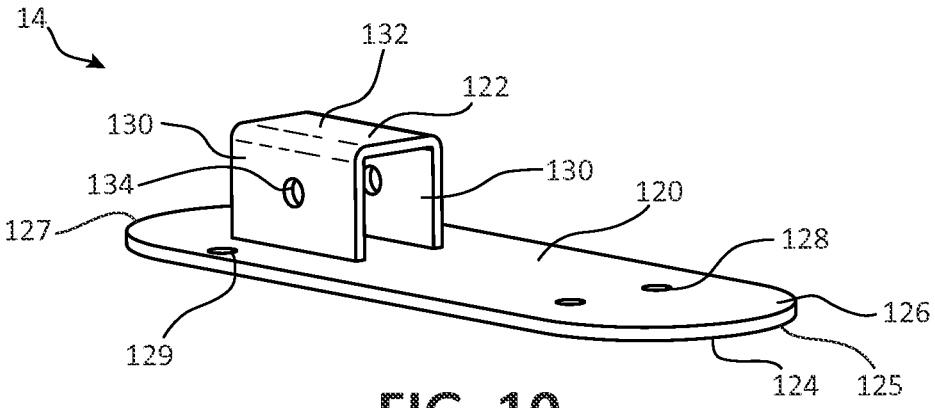
FIG. 10 is a front, perspective view of a mounting foot of the media display assembly of FIG. 2, according to one embodiment of the present invention.

Referring to FIG. 10, mounting component 14, otherwise referred to as a mounting foot, is includes a plate 120 and a protrusion 122. Plate 120 is substantially planar and defines a bottom surface 124 and a top surface 126 opposite bottom surface 124. In one example, plate 120 is substantially rectangular in shape defining a first transverse end 125 and a second transverse edge 127 opposite first transverse end 127 with each of first and second transverse ends 125 and 127 being either substantially linear and/or curvilinear. A first pair or set of apertures 128 are formed through plate 120 nearer first transverse end 125 than second transverse end 127, and each aperture in first pair apertures 128 is longitudinally aligned and transversely offset from the other aperture in first pair of apertures 128. A second pair or set of apertures 129 are formed through plate 120 nearer second transverse end 127 than first transverse end 125, and each aperture in second pair of apertures 129 being longitudinally aligned and transversely offset from the other aperture in the second pair of apertures 129.

In one embodiment, protrusion 122 extends upwardly from and is coupled to top surface 126 of plate 120. In one example, protrusion 122 is an inverted U-shape defining two, opposing sidewalls 130 and a top wall 132 extending therebetween. An aperture 134 is formed through each of the two, opposing sidewalls 130 to longitudinally align with one another. In one example, apertures 134 and apertures 128 all are substantially longitudinally aligned with one another.

Mounting component 14 is used to couple first end 80 of divider support 12 to base deck 40 of merchandising display unit 20, and in one example, is configured for selective use in one of two orientations depending upon the particular dimensions of merchandising display unit 20. In a first orientation, as illustrated in FIGS. 1-9 and the cross-sectional view of FIG. 11, mounting component 14 is positioned such that first transverse edge 125 is nearer, but still rearwardly offset from, front edge 50 of base deck 40 than second transverse edge 127. Apertures 128 align with apertures 54 of base deck 40, and suitable fasteners 136 are inserted through apertures 128 and 54 to secure base plate 120, and therefore, mounting component 14 to base deck 40.

First end 80 of divider support 12 is placed over protrusion 122 such that protrusion 122 is positioned substantially fully within cavity 84 of substantially vertical section 70 of divider support 12 and first exposed edge 81 abuts and contacts top surface 126 of plate 120 of mounting component 14. A suitable fastener 138, e.g., a screw and nut, rivet, lock pin, etc., is thread through apertures 86 in substantially vertical section 70 of divider support 12 and apertures 134 through protrusion 122 of mounting component 14, thereby securing divider support 12 to base deck 40 via mounting component 14.

In one embodiment, mounting component 14 is used in the first orientation of FIGS. 1-9 and 11 when a first size of base deck 40 is used, more specifically, a base deck 40 having apertures 54 thereof spaced a first distance from vertical wall 42 of merchandise display unit 20. Mounting component 14 is used on a second orientation, rotated one-hundred and eighty degrees from the first orientation, when a second size of base deck 40 is used, more specifically, a base deck 40 having apertures 54 thereof spaced a second distance from vertical wall 42 of merchandise display unit 20.

Figure 12:
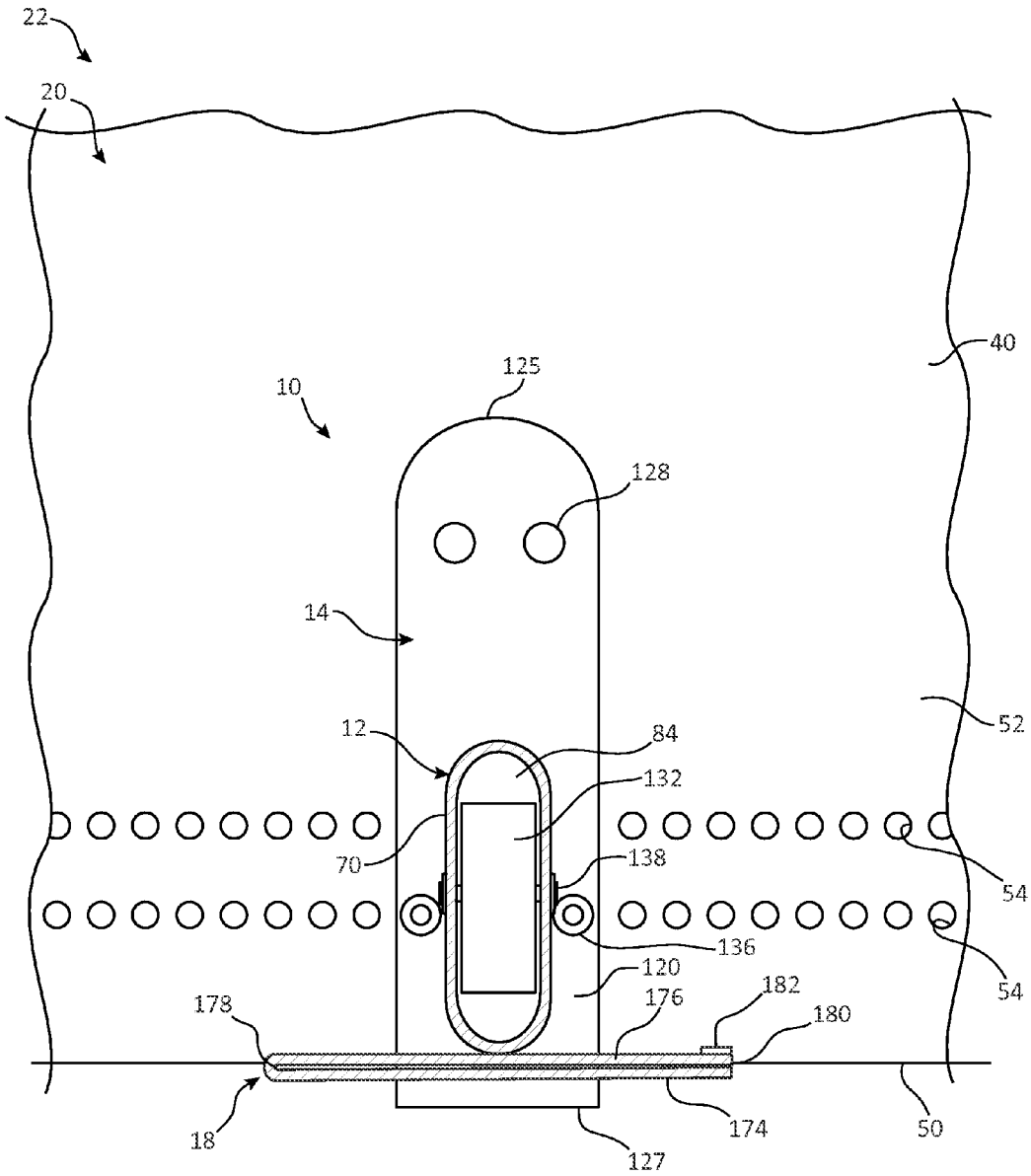
FIG. 12 is an alternative cross-sectional view to FIG. 11 when a mounting foot of the media display assembly is positioned with an opposite orientation relative to a base deck of a merchandising display as compared to FIG. 11, according to one embodiment of the present invention.

More specifically, the cross-sectional view of FIG. 12 illustrates mounting component 14 in a second orientation such that first mounting component 14 is positioned such that second transverse edge 127 is nearer, but still rearwardly offset from, front edge 50 of base deck 40 than first transverse edge 125. Second pair of apertures 129, rather than first pair of apertures 128, align with apertures 54 of base deck 40, and suitable fasteners 136 are inserted through each aperture of the second pair of apertures 129 and 54 to secure base plate 120, and therefore, mounting component 14 to base deck 40 in the second orientation.

The versatility resulting from the two available orientations of mounting component 14 is particularly advantageous as base decks 40 are commonly provided in two standard sizes one of which measures about eighteen inches from front to back and one of which measures about twenty-two inches from front to back. Mounting component 14 works with both standard base deck sizes, just needing to be placed in a corresponding one of a first orientation or a second orientation depending upon the size of base deck 40. For example, as described herein, second orientation is used with a smaller size base deck 40 and results in divider support 12 extending nearer front end 50 of base deck 40 than when the second orientation of mounting component 14 is used with a larger size base deck 40.

Figure 9:
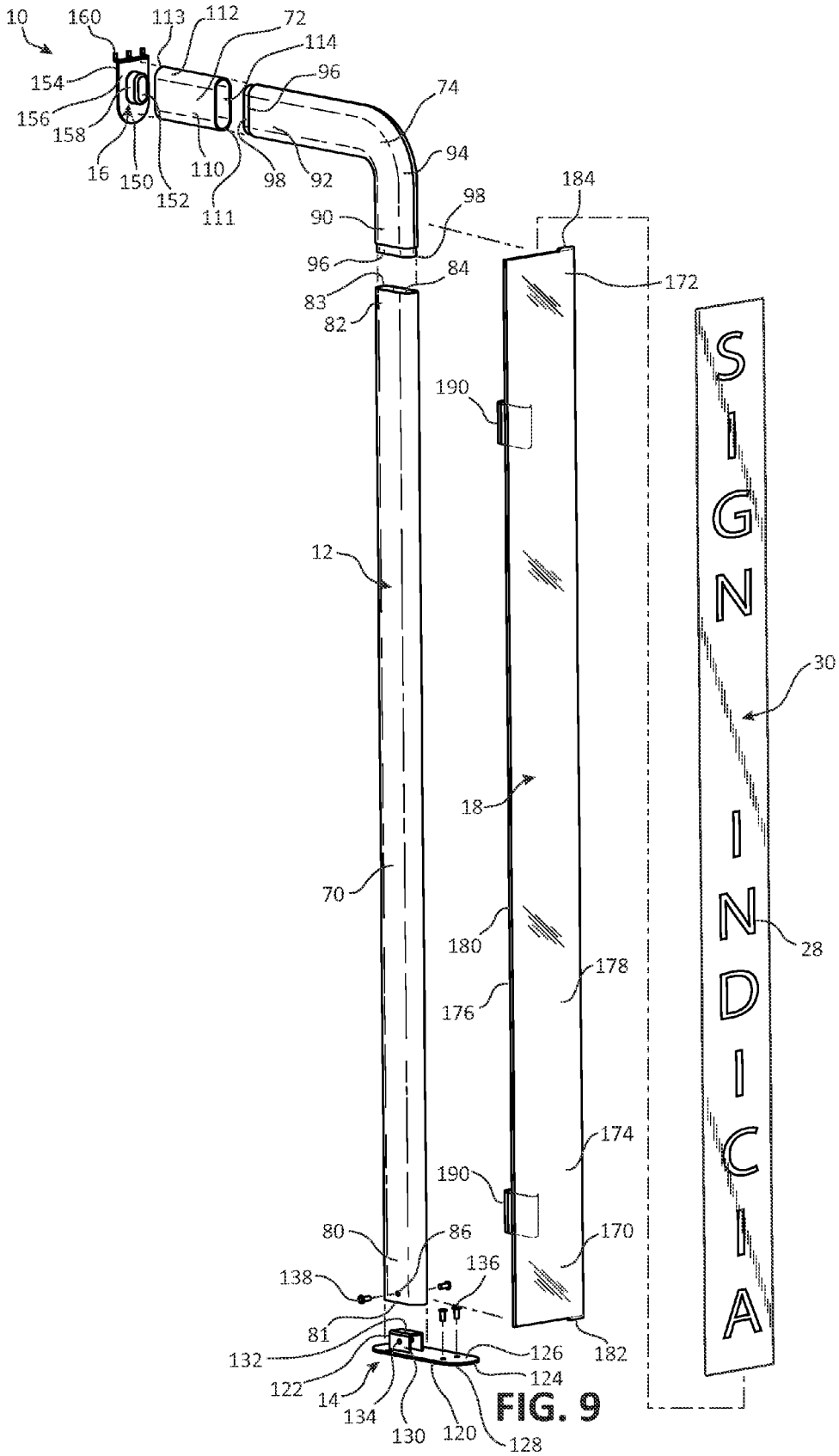
FIG. 9 is an exploded, front, perspective view illustration of the media display assembly of FIG. 2, according to one embodiment of the present invention.

One example of a suitable mounting component 16 is illustrated in FIGS. 1-9. Referring primarily to FIG. 9, mounting component 16 includes a plate 150, protrusion 152, and hooks or pegs 160. Plate 150 is substantially planar and defines a rear surface 154 and a front surface 156 opposite rear surface 154. Protrusion 152 extends forwardly from and is substantially centered relative to front surface 156 of plate 150. In one example, protrusion 152 is shaped substantially identically to and sized just slightly smaller than cavity 114 of substantially horizontal section 72 of divider support 12. Pegs 160 each extend rearwardly and then upwardly from a top edge of plate 150 and spaced a distance substantially identical to the spacing of apertures 60 of pegboard panel 56 (FIG. 1). As such, pegs 160 are configured to each be received within a corresponding aperture 60 of pegboard panel 56 to selectively hang mounting component 16 from pegboard panel 56 in a manner placing rear surface 154 of plate 150 of mounting component 16 in contact with or at least facing front surface 58 of pegboard panel 56.

Primarily referring to FIGS. 1 and 9, rear end 112 of substantially horizontal section 72 of divider support 12 fits over protrusion 152 of mounting component 16 such that protrusion 152 is snugly positioned within cavity 114 and exposed edge 113 faces and, in one example, contacts and abuts front surface 156 of plate 150 of mounting component 16. Divider support 12 is, thereby, secured to mounting component 16 via friction or interference fit or a combination of friction fit, adhesive, ultrasonic welding, and/or other fastener as will be apparent to those of skill in the art upon reading this application. In view of the above, divider support 12 is selectively secured to vertical wall 42 (FIG. 1) via mounting component 16. In this manner, divider support 12 forms an inverted "L" shape with one end being coupled to base deck 40 of merchandise display unit 20 and an opposite end being coupled to pegboard panel 56 of merchandise display unit 20. In one embodiment, divider support 12 is only coupled to merchandise display unit 20 at the two opposing free ends as characterized by an absence of other supports or direct or indirect couplings to merchandise display unit 10. In view of the above, mounting components 14 and 16 are means for coupling substantially vertical section 70 and substantially horizontal section 72 to base deck 40 and pegboard panel 56, respectively.

Figure 11:
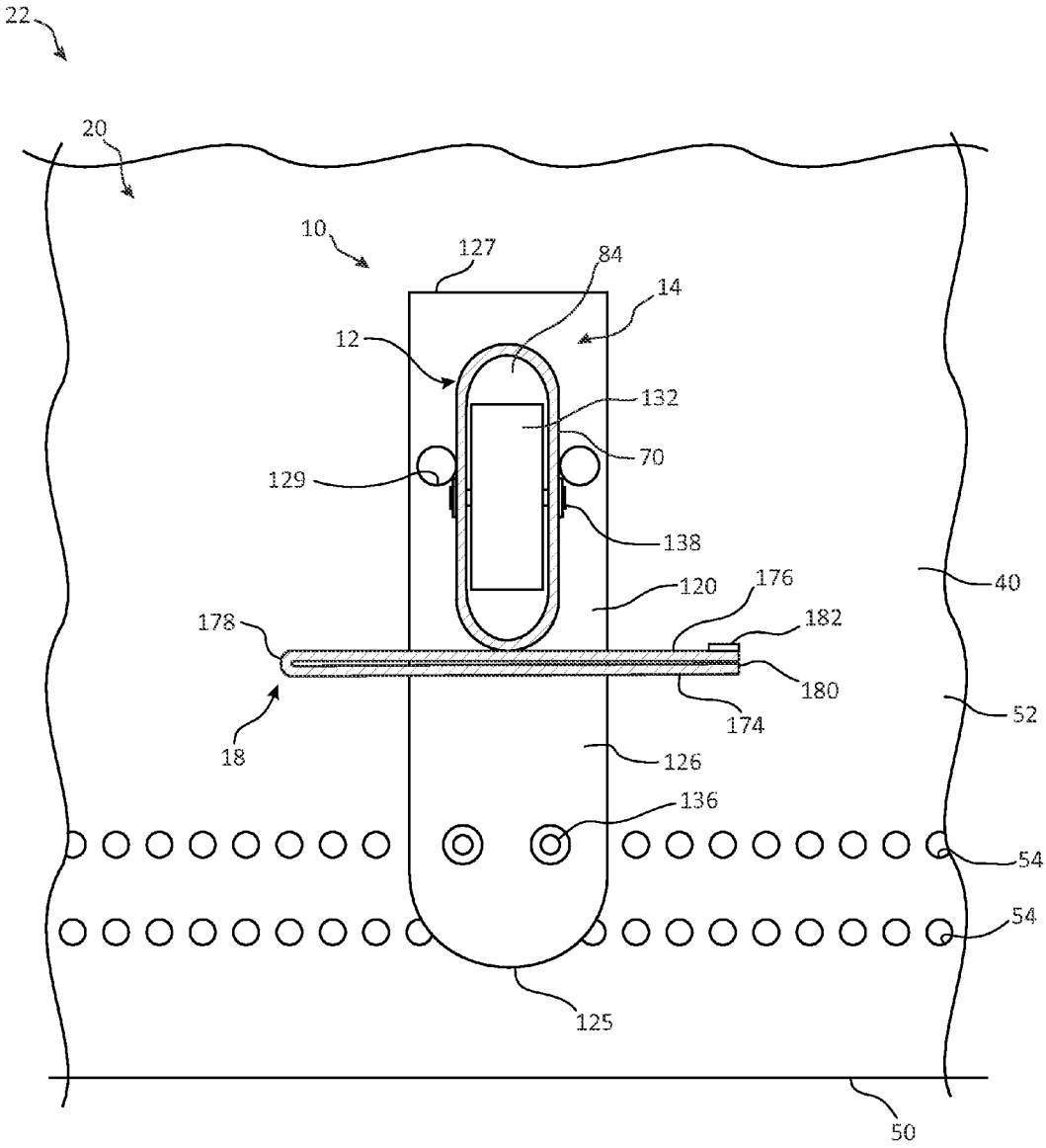
FIG. 11 is a cross-sectional view of the merchandising system taken about the line X-X in FIG. 1, according to one embodiment of the present invention.

As briefly described above, sign holder 18 is supported on divider support 12, for example, by hanging sign holder 18 to extend over and along a frontmost edge of substantially vertical support 12 of divider support 12. Referring primarily to FIGS. 9 and 11, in one embodiment, sign holder 18 is elongated and defines and extends substantially linearly between a first or bottom end 170 and a second or top end 172, which is positioned opposite bottom end 170. Sign holder 18 includes a front panel 174 and a rear panel 175 opposite front panel 174, which are secured to one another along a closed, longitudinal edge 178 thereof. Each of front panel 174 and rear panel 176 extend laterally from closed, longitudinal edge 178 to an open longitudinal edge 180 such that sign holder 18 is formed in a substantially flattened C-shape with a flattened slot for receiving sign 28. In one embodiment, sign holder 18 is formed of a biased or sufficiently elastic material biasing front panel 174 toward rear panel 176 such that even when front panel 174 is manipulated or bent to move away from rear panel 176 to insert sign 28 therein or for other reason, when released, front panel 174 pushes back toward rear panel 176 maintaining sign 28 tightly between front panel 174 and rear panel 176.

In one example, sign holder 18 includes integral or separately formed hooks. More particularly, sign holder 18 includes a bottom hook 182 and a top hook 184 extending from opposing end edges of front panel 174 and curling rearwardly and toward one another (i.e., upwardly and downwardly, respectively) at least partially over a rear surface of rear panel 176 to assist in holding front panel 174 against rear panel 176 and/or closing open longitudinal edge 180. In one embodiment, sign 28 is sized with a substantially identical shape and slightly smaller overall height and width of front panel 174 and/or rear panel 176. In one example, sign holder 18 is formed from a single piece of material that is substantially transparent or translucent such that sign 28 is visible through at least front panel 174 thereof. In other examples, portions of sign holder 18, e.g., portions that are less than all of front panel 174, are substantially translucent or transparent allowing portions of sign 28 to be visible therethrough.

Figure 13:
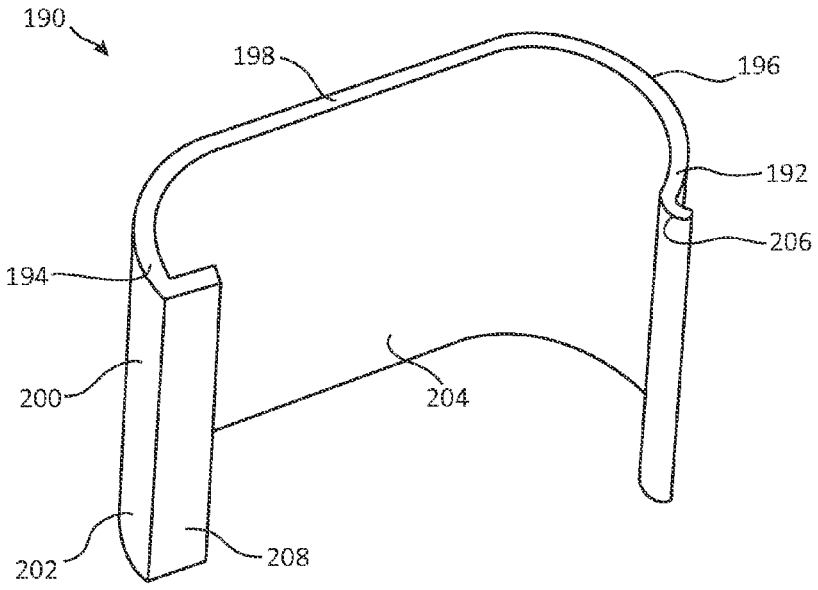
FIG. 13 is a sign holder clip configured to selectively couple a sign holder to a divider of the media display assembly, according to one embodiment of the present invention.

Sign holder 18 is coupled to substantially vertical section 70 of divider support 12 with a suitable fastener, for example, with sign holder clips 190 illustrated in FIG. 13. In the illustrated embodiment, each sign holder clip 190 defines a first end 192 and a second end 194 opposite first end 192 where sign holder clip 190 is curvilinear forming a substantially C-shape as it extends from first end 192 to second end 194. In one example, each sign holder clip 190 defines a front segment 196, an intermediate segment 198, and a rear segment 200. Both of front segment 196 and rear segment 198 extend from opposing edges of intermediate segment 198 in a common direction. Front segment 196, intermediate segment 198, and rear segment 200 collectively define an external surface 202 and an internal surface 204 of sign holder clip 190 where internal surface 204 is configured to fit snugly around, directly adjacent to, and directly contacting an exterior surface of substantially vertical section 70.

In one example, each sign holder clip 190 defines a front curl 206 at first end 192, e.g., as part of front segment 196. Front curl 206 bends front segment 196 forwardly to a position substantially coplanar with an otherwise frontmost edge of front segment 196. In this manner, each of front curl 206 and the frontmost edge of front segment 196 separately contacts and is secured to a rear surface of rear panel 176. The two distinct points of contact between each sign holder clip 190 and sign holder 18 provides a more stable and secure coupling than a single point of contact generally decreasing rotation of sign holder 18 relative to sign holder clips 190 and divider support 12 as will be further described below. However, other couplings utilizing a single point of contact are also contemplated for use with media display assembly 10. In one embodiment, each sign holder clip 190 is substantially permanently and substantially immovably coupled to sign holder 18.

Figure 14:
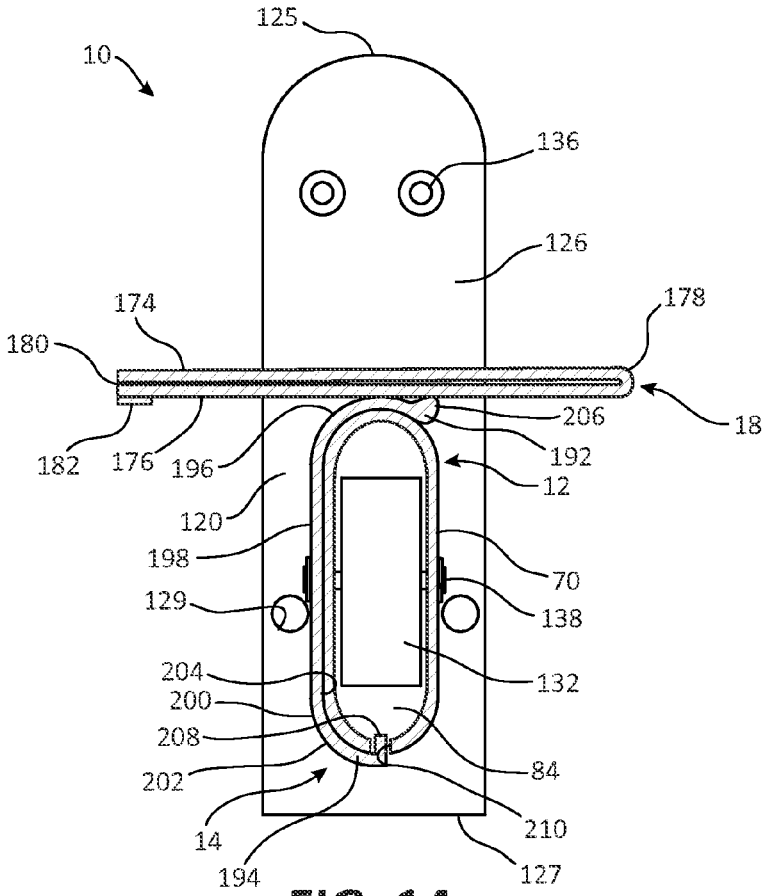
FIG. 14 is a cross-sectional view of the media display assembly taken along the line Y-Y in FIG. 4, according to one embodiment of the present invention.

Each sign holder clip 190 additionally includes a rear return flange 208 extending from second end 194 of rear segment 200 straight forwardly toward front segment 196 according to one embodiment. In such an embodiment, substantially vertical section 70 of divider support 12 defines elongated slots 210 extending from a rearmost surface through a rear wall thereof and into cavity 84, that is, if cavity 84 extends through the entire length of substantially vertical section 70. Referring additionally to the cross-sectional view of FIG. 14, each elongated slot 210 has a width just slightly larger than a thickness of rear return flange 208 and a height just slightly taller than a height rear return flange 208 of each sign holder clip 190. Elongated slots 210 are vertically positioned to align with the position of each rear return flange 208 on sign holder 18. For example, as illustrated, two elongated slots 210 are formed, each near a different one of bottom end 80 and top end 82 and two sign holder clips 190 are attached to sign holder 18, each near a different one of bottom end 170 and top end 172 thereof.

Sign holder 18 is coupled to substantially vertical section 70 by stretching sign holder clips 190 to fit around portions of substantially vertical section 70 (e.g., front, side, and rear portions) and placing a rear return flange 208 of each sign holder clip 190 into a corresponding elongated slot 210 formed by substantially vertical section 70. Once in place, each sign holder clip 190 returns to its un-stretched dimensions to tightly interact with portions of at least three sides of substantially vertical section 70 holding the respective sign holder clip 190 around and in contact with substantially vertical section 70 according to the illustrated embodiments. Interaction between each rear return flange 208 and a bottom edge of the corresponding elongated slot 210 of substantially vertical section 70 maintains sign support clip 190 in a desired vertical position and substantially prevents vertical sliding of sign holder clips 190, and therefore, of sign holder 18, relative to substantially vertical section 70. In view of the above, substantially vertical section 70 is one example of means for supporting sign holder 18.

Media display assembly 10, as described herein and as will be apparent to those of skill in the art upon reading this application, provides a versatile, aesthetically pleasing, and easy to install fixture that, in some embodiments, functions to both visually divide merchandising system 22 (FIG. 1) and to provide informative, marketing, brand-related, or other meaningful indicia 30 to consumers in a flat and easy to read format. In one embodiment, sign holder 18 is sized with sufficient height and width to substantially cover an entirety, for example, at least about 90%, of substantially vertical section 70 of divider support 12 as illustrated, for example, in FIGS. 1, 2, and, in particular, 3. By largely hiding divider support 12, sign 28 becomes the focal point with divider support 12 largely fading into the background of merchandising system 22 such that divider support 12 does not detract from products 24 on display nearby or the message of sign 28. Given the types of mounting components 14 and 16 and sign holder clips 190 used, in one embodiment, media display assembly 10 is also easily disassembled and, in some instances, reused at a later time or in a different part of a retail store.

Although the invention has been described with respect to particular embodiments, such embodiments are meant for illustrative purposes only and should not be considered to limit the invention. Various alternatives and changes will be apparent to those of ordinary skill in the art. Other modifications within the scope of the invention and its various embodiments will be apparent to those of ordinary skill.

What is claimed is:

1. A media display assembly comprising:

a support defining a substantially vertical section, a substantially horizontal section, and a bent transition section extending between the substantially vertical section and the substantially horizontal section, the support being formed in an inverted substantially L-shape;

a sign holder including a first panel and a second panel sized substantially identically to the first panel, the first panel and the second panel being coupled to one another along a closed edge of the sign holder and defining a slot between the first panel and the second panel for receiving a sign, wherein:

the second panel of the sign holder is coupled to the substantially vertical section of the support on a side of the substantially vertical section opposite the substantially horizontal section, the second panel of the sign holder extends in a plane substantially perpendicular to the substantially horizontal section of the support, and the substantially vertical section of the support includes an elongated opening extending through a side of the substantially vertical section opposite the sign holder; and a sign holder clip formed in a C-shape, wherein:

the sign holder clip extends around at least a portion of three sides of the substantially vertical section, the sign holder clip includes a return flange extending from an end of the sign holder clip into the elongated opening of the substantially vertical section, the second panel of the sign holder is secured to a portion of the sign holder clip opposite the return flange, and the sign holder clip defines two distinct points of contact and coupling with the second panel of the sign holder.

2. The media display assembly of claim 1, wherein the sign holder is formed as a single piece.

3. The media display assembly of claim 2, wherein the sign holder is one of substantially transparent and translucent.

4. The media display assembly of claim 1, further comprising a substantially planar sign secured between the first panel and the second panel of the sign holder.

5. The media display assembly of claim 4, wherein the sign holder and the substantially planar sign collectively substantially hide the substantially vertical section of the support from a viewpoint on a side of the sign holder opposite the support.

6. The media display assembly of claim 4, wherein:

the closed edge of the sign holder is a closed, longitudinal edge of the sign holder, the sign holder defines an open longitudinal edge opposite the closed, longitudinal edge to facilitate receiving the substantially planar sign in the slot between the first panel and the second panel of the sign holder, and the substantially planar sign has a length substantially equal to a length of the sign holder.

7. The media display assembly of claim 1, wherein the sign holder has a length covering at least about 90% of an overall length of the support.

8. The media display assembly of claim 1, wherein the sign holder clip is permanently and substantially immovably coupled with the second panel of the sign holder.

9. The media display assembly of claim 1, further comprising:

a first mounting component coupled to a first free end of the substantially vertical section; and a second mounting component coupled to a second free end of the substantially horizontal section, wherein:

the first mounting component is configured to couple to a first base deck of a merchandise display unit via apertures defined by the first base deck, and the second mounting component include pegs configured to couple with a vertical pegboard panel of the merchandise display unit, the vertical pegboard panel extending substantially perpendicular to the base deck.

10. The media display assembly of claim 9, in combination with the merchandise display unit, wherein the first mounting component is coupled to a top surface of the first base deck via the apertures defined by the first base deck, and the second mounting component is coupled to the vertical pegboard panel by placing the pegs of the second mounting component in holes defined by the vertical pegboard panel.

11. The media display assembly of claim 10, wherein the support is only coupled to the merchandise display unit via the first mounting component and the second mounting component.

12. The media display assembly of claim 1, wherein the support is formed of one or more closed tubular members, the one or more closed tubular members collectively defining each of the substantially vertical section, the substantially horizontal section, and the bent transition section.

13. The media display assembly of claim 1, further comprising a mounting component selectively coupled to a bottom of the support in one of two available orientations, wherein each of the two available orientations is rotated about 180° from the other of the two available orientations, one of the two available orientations is configured for coupling the support to a smaller sized base deck, and the other one of the two available orientations is configured for coupling the support to a larger sized base deck.

14. The media display assembly of claim 13, wherein the mounting component includes a base plate and a protrusion, the protrusion extends upwardly from the base plate and is received within the bottom of the support, the base plate includes a first set of coupling holes and a second set of coupling holes, the first set of coupling holes is positioned closer to the protrusion than the second set of coupling holes and is configured for use with the smaller sized base deck, and the second set of coupling holes is configured for use with the larger sized base deck.

15. An assembly for use with a merchandise display unit, the merchandise display unit including a base deck having a substantially horizontal top surface and a substantially vertically extending wall, the assembly comprising:

an elongated, substantially vertically extending sign holder including means for compressively holding a substantially planar sign between two panels;

means for supporting the elongated, substantially vertically extending sign holder above the base deck;

means for coupling the means for supporting to the base deck using an array of apertures defined through the substantially horizontal top surface of the base deck, wherein:

the means for coupling the means for supporting is configured to be used in two different orientations to couple the means for supporting to at least two sizes of base decks, and each of the two orientations of the means for coupling the means for supporting is rotated about 180° as compared to the other one of the two different orientations;

means for extending from a top of the means for supporting rearwardly toward the substantially vertically extending wall; and means for coupling the means for extending with the substantially vertically extending wall.

16. The assembly of claim 15, wherein at least one of the two panels is one of substantially transparent and translucent.

17. The assembly of claim 15, wherein:

the two panels are sized substantially identically to one another and each has a length greater than about 90% of an overall length of the means for supporting, and the means for extending extend from a side of the means for supporting opposite a side of the means for supporting that interacts with the elongated, substantially vertically extending sign holder.

18. A method of installing a sign as part of a merchandising system, the method comprising:

securing a mounting foot to a base deck of a merchandise display unit using two or more apertures defined through the base deck, wherein:

securing the mounting foot to the base deck includes securing the mounting foot to the base deck in one of two available orientations of the mounting foot, the one of the two available orientations is selected based on the size of the base deck, and each of the two orientations of the mounting foot is rotated about 180° relative to the other of the two available orientations;

selectively coupling a bottom end of an inverted, L-shaped structure to the mounting foot, wherein the bottom end of the inverted, L-shaped structure is defined at a front of the inverted, L-shaped structure and a rear end of the inverted, L-shaped structure is rearwardly offset from the bottom end;

selectively coupling the rear end of the inverted, L-shaped structure to a substantially vertically extending pegboard panel of the merchandise display unit, the substantially vertically extending pegboard panel extending upwardly from the base deck;

selectively securing an elongated sign holder to the inverted, L-shaped structure; and placing a sign in the elongated sign holder, wherein the elongated sign holder and the sign collectively cover a substantial entirety of a substantially vertically extending length of the inverted, L-shaped structure, and placing the sign in the elongated sign holder includes sliding the sign in between two substantially planar walls of the elongated sign holder, at least one of the two substantially planar walls being one of substantially transparent and translucent.

19. The method of claim 18, wherein selectively securing the elongated sign holder to the inverted, L-shaped structure includes securing clips, which are immovably secured to the elongated sign holder, around at least a portion of three sides of the inverted, L-shaped structure and positioning each of the clips to extend at least partially through slots defined through the inverted, L-shaped structure.

20. A media display assembly comprising:

a support defining a substantially vertical section, a substantially horizontal section, and a bent transition section extending between the substantially vertical section and the substantially horizontal section, the support being formed in an inverted substantially L-shape; and a sign holder including a first panel and a second panel sized substantially identically to the first panel, the first panel and the second panel being coupled to one another along a closed edge of the sign holder and defining a slot between the first panel and the second panel for receiving a sign, wherein:

the second panel of the sign holder is coupled to the substantially vertical section of the support on a side of the substantially vertical section opposite the substantially horizontal section, and the second panel of the sign holder extends in a plane substantially perpendicular to the substantially horizontal section of the sup sort the closed edge of the sign holder is a closed, longitudinal edge of the sign holder, the sign holder defines an open longitudinal edge opposite the closed, longitudinal edge to facilitate receiving the substantially planar sign in the slot between the first panel and the second panel of the sign holder, the substantially planar sign has a length substantially equal to a length of the sign holder, the sign holder further comprises at least one hook maintaining the first panel of the sign holder tightly against the second panel near the open longitudinal edge of the sign holder, and the at least one hook is integrally formed as a single piece of material with the first panel.

21. A media display assembly comprising:

a support defining a substantially vertical section, a substantially horizontal section, and a bent transition section extending between the substantially vertical section and the substantially horizontal section, the support being formed in an inverted substantially L-shape;

a sign holder including a first panel and a second panel sized substantially identically to the first panel, the first panel and the second panel being coupled to one another along a closed edge of the sign holder and defining a slot between the first panel and the second panel for receiving a sign;

a first mounting component coupled to a first free end of the substantially vertical section, wherein the first mounting component is configured to couple to a first base deck of a merchandise display unit via apertures defined by the first base deck; and a second mounting component coupled to a second free end of the substantially horizontal section, wherein the second mounting component include pegs configured to couple with a vertical pegboard panel of the merchandise display unit, the vertical pegboard panel extending substantially perpendicular to the base deck;

wherein:

the second panel of the sign holder is coupled to the substantially vertical section of the support on a side of the substantially vertical section opposite the substantially horizontal section, the second panel of the sign holder extends in a plane substantially perpendicular to the substantially horizontal section of the support, the first mounting component includes a plate and a protrusion, the plate defines a first edge and a second edge opposite the first edge, the protrusion extends from a top surface of the plate nearer the second edge than the first edge and is coupled to the first free end of the substantially vertical section of the support, the plate defines a first pair of apertures and a second pair of apertures, the first pair of apertures being positioned nearer the first edge than the second pair of apertures, the first pair of holes are configured to align with the apertures defined by the first base deck extending a first distance from a corresponding vertical pegboard panel to facilitate coupling of the first mounting component to the first base deck, the second pair of holes are configured to align with apertures defined by a second base deck extending a second distance from corresponding vertical pegboard panel to facilitate coupling of the first mounting component to the second base deck, and the first distance is greater than the second distance.

* * * * *